United States Patent [19]

Shields

[11] 4,055,013

[45] Oct. 25, 1977

[54] IDENTIFICATION DEVICE FOR VEHICLES

[76] Inventor: James A. Shields, 5537 Lydia, Kansas City, Mo. 64110

[21] Appl. No.: 680,430

[22] Filed: Apr. 26, 1976

[51] Int. Cl.[2] ..... G09F 07/08; G09F 21/04

[52] U.S. Cl. ..... 40/129 C; 40/140; 40/145 A

[58] Field of Search ..... 40/129 C, 145 A, 142 R, 40/140, 125 H, 125 N

[56] References Cited

U.S. PATENT DOCUMENTS

| | | | |
|---|---|---|---|
| 1,532,865 | 4/1925 | Beck | 40/145 A |
| 1,861,599 | 6/1932 | Gstalder | 40/142 R |
| 2,074,250 | 3/1937 | Bone | 40/129 C |
| 2,520,648 | 8/1950 | Newman | 40/140 |
| 2,591,196 | 4/1952 | Post | 40/129 C |
| 2,636,300 | 4/1953 | Suckle | 40/140 |
| 3,968,977 | 7/1976 | Wilfert | 40/129 C X |

*Primary Examiner*—John F. Pitrelli

*Attorney, Agent, or Firm*—Schmidt, Johnson, Hovey & Williams

[57] ABSTRACT

This device consists primarily of a mounting plate in which are removably received spaced apart letters, having base means for enabling them to be secured within the mounting plate by suitable fasteners, the bases of the letters abutting with each other, and the device includes a hinged and spring loaded portion which will enable the letters to be reflected rearwardly if struck by a pedestrian.

1 Claim, 4 Drawing Figures

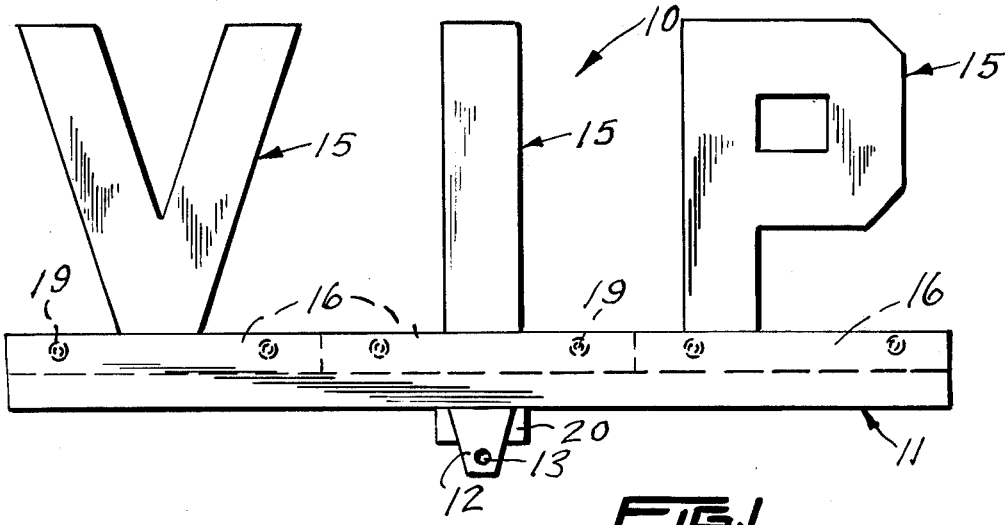
FIG. 1
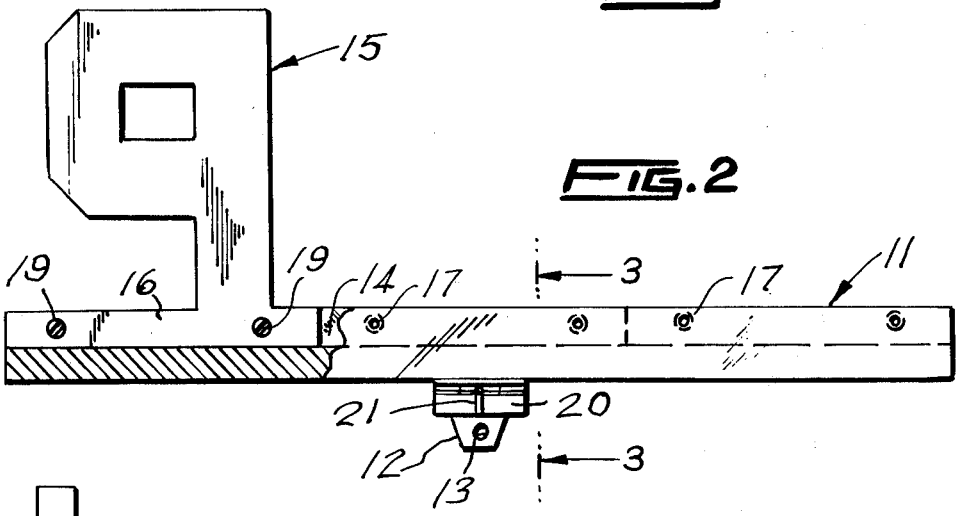
FIG. 2
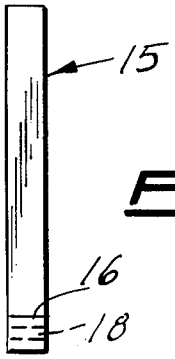
FIG. 4
FIG. 3
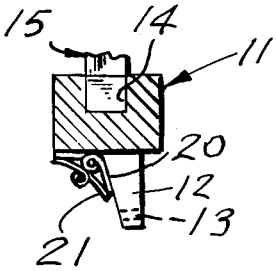

IDENTIFICATION DEVICE FOR VEHICLES

This invention relates to name plates, and more particularly to an identification device for vehicles.

It is, therefore, the principal object of this invention to provide an identification device for automotive vehicles, which will have removable letter characters therein.

Another object of this invention is to provide an identification device of the type described, which will have the removable letters secured within groove means of the mounting plate.

A further object of this invention is to provide an identification device of the type described, which will have the letters terminated at the bottom by a projection which will provide automatic spacing for the letters when they are secured within the mounting plate.

A still further object of this invention is to provide an identification device of the type described, which will have the mounting plate hinged and spring loaded to a central lug so that, if the letters are struck by a pedestrian in the event the vehicle strikes the pedestrian, no puncture will occur to the the struck pedestrian.

Other objects of the invention are to provide an identification device, which is simple in design, inexpensive to manufacture, rugged in construction, easy to use and efficient in use.

These and other objects will be readily evident upon a study of the following specification together with the accompanying drawing, wherein FIG. 1 is a front view of the present invention, shown in elevation;

FIG. 2 is a rear view of FIG. 1, showing some of the removable letter character members, removed therefrom;

FIG. 3 is a cross-sectional view taken along line 3—3 of FIG. 2; and FIG. 4 is an edgewise view of one of the letter character members of the device.

According to this invention, an identification device 10 is shown to include a mounting plate 11 of U-shaped cross-sectional configuration. A central lug 12, is secured fixedly to the bottom of mounting plate 11, and is provided with opening 13 means for receiving suitable fastener means for securing device 10 to the hood of a vehicle (not shown).

The opening 14, of mounting plate 11, extends longitudinally the length of mounting plate 11, and slideably receives the plurality of letter members 15. Each of the letter members 15 is provided with a base portion 16, which extends from each side edge of the letter members 15, the base portion 16 being made integral of the letter members 15. A plurality of spaced apart and transverse openings 17 through mounting plate 11, provide a means of fastening letter members 15 thereto. Openings 17 align with similar openings 18 through the base portions 16 of letter members 15, and through fasteners 19 are received in openings 17 and 18 so as to render letter members 15 secure within mounting plate 11. A hinge 20 is secured at one side fixedly, to lug 12 and is fixedly secured at its opposite side to the bottom of mounting plate 11, so as to enable the letter member 15 to be urged rearward if struck. A spring 21 is secured at one side to an edge of hinge 20 at the central lug 12, and secured at its opposite end to the opposite side of hinge 20, the spring 21 serving as a means of urging the mounting plate 11 and letters 15 forward in an upright position and, if letters 15 are struck, the mounting plate 11 and letter members 15 are urged harmlessly rearward.

As shown in FIGS. 1 and 2 the base portions 16 are equal in length and the combined length of the base portions 16 is equal to the length of the opening 14 in plate 11. Further, as shown in FIG. 3, the width and length of the portions 16 is substantially equal to the width and depth of the opening 14. Hence, the portions 16 mate with the opening 14 in such a manner as to present a smooth and continuous profile.

It will be noted that mounting plate 11 may be of a suitable flexible material if desired and the letters 15 may be made of metal that is chrome or otherwise plated.

What I now claim is:

1. An identification device for an automotive vehicle having a hood, said device including:

an elongate mounting plate having a top and bottom surface;

a groove formed in said top surface and extending longitudinally of the plate;

a hinged lug mounted on said bottom surface for swinging movement toward and away from the latter, said lug being adapted for securement on the hood of said vehice;

a plurality of letter elements adapted for mounting on said plate in side-by-side relationship;

each of said elements being provided with a normally upright character portion and elongate base portion removably received within said groove, said base portion extending a predetermined distance beyond the side edges of its respective character portion whereby endwise abutment of said base portion against the base portion of an adjacent letter element provides preselected spacing between the respective character portion and the character portion of said adjacent element;

screw fastener means in said plate for releasably securing the base portion of each element within said groove; and spring means yieldably biasing said lug toward said surface whereby, when said lug is mounted on said hood, said letter members may be deflected rearwardly when struck by a pedestrian.

* * * * *